US006352107B1

(12) United States Patent
Bennett et al.

(10) Patent No.: US 6,352,107 B1
(45) Date of Patent: Mar. 5, 2002

(54) WEAR RESISTANT WELL PUMP ROD AND METHOD FOR MAKING SAME

(75) Inventors: Donald W. Bennett, Midland; Johnny B. Fayo, Odessa; Scott W. Long, Midland, all of TX (US)

(73) Assignee: Allen & Bennett, Inc., Odessa, TX (US)

( * ) Notice: Subject to any disclaimer, the term of this patent is extended or adjusted under 35 U.S.C. 154(b) by 0 days.

(21) Appl. No.: 09/248,873

(22) Filed: Feb. 11, 1999

(51) Int. Cl.[7] ..... E21B 17/00; E21B 17/10; E21B 43/00

(52) U.S. Cl. ..... 166/105; 166/241.4; 166/242.6; 417/448

(58) Field of Search ..... 166/68, 105, 241.2, 166/241.3, 241.4, 242.1, 242.6, 242.7; 417/448

(56) References Cited

U.S. PATENT DOCUMENTS

| | | | | | |
|---|---|---|---|---|---|
| 2,863,704 | A | * | 12/1958 | Hillman | 166/241.4 |
| 3,948,575 | A | | 4/1976 | Rosser | |
| 4,024,913 | A | * | 5/1977 | Grable | 166/242.1 X |
| 4,205,926 | A | * | 6/1980 | Carlson | 166/68 X |
| 4,597,438 | A | | 7/1986 | Bennett | |
| 4,646,517 | A | * | 3/1987 | Wright | 60/371 |
| 4,653,953 | A | * | 3/1987 | Anderson et al. | 403/268 |
| 4,697,641 | A | | 10/1987 | White | |
| 4,858,688 | A | * | 8/1989 | Edwards et al. | 166/241.4 |
| 4,905,760 | A | | 3/1990 | Gray | |
| 4,936,383 | A | | 6/1990 | Towner et al. | |
| 4,938,285 | A | | 7/1990 | Edwards et al. | |
| 5,339,896 | A | * | 8/1994 | Hart et al. | 166/241.2 X |
| 5,437,342 | A | | 8/1995 | Powada | |
| 5,509,475 | A | | 4/1996 | Lewis | |
| 5,511,619 | A | | 4/1996 | Jackson | |
| 5,941,312 | A | * | 8/1999 | Vermeeren | 166/241.2 X |

* cited by examiner

*Primary Examiner*—George Suchfield
(74) *Attorney, Agent, or Firm*—Gardere Wynne Sewell LLP

(57) ABSTRACT

An elongated pump rod or sinkerbar for use in a pump rod string for a downhole reciprocating well pump is provided with an elongated sleeve of high density or ultra high density polyethylene over a major portion of the length of the sinkerbar to minimize wear on the sinkerbar and a well tubing string as a consequence of deflection of the sinkerbar into engagement width the tubing string and to minimize frictional drag on the pump actuating mechanism as a result of such engagement. The polyethylene sleeve may be assembled over the sinkerbar by apparatus including an elongated hydraulic actuator which may be configured to push a sinkerbar into the sleeve while the sleeve is held stationary within a support tube, or by holding the sinkerbar stationary on a support and pulling the sleeve over the sinkerbar and from a continuous length of tubing from which the sleeve is formed.

18 Claims, 3 Drawing Sheets

WEAR RESISTANT WELL PUMP ROD AND METHOD FOR MAKING SAME

FIELD OF THE INVENTION

The present invention pertains to well pump rod, including a rod commonly known as a sinkerbar, which is provided with a high density polyethylene sleeve disposed thereover to minimize wear on the rod and well tubing in which it is disposed. The invention also pertains to preferred methods and apparatus for applying a polyethylene sleeve to a pump rod or "sinkerbar".

BACKGROUND

Downhole well pumps which utilize elongated strings of so-called "sucker rods" as the pump actuating mechanism are widely used for various well pumping applications. Although it was once and long-considered a suitable design to provide a pump rod string, with rod sections having the smallest diameter disposed in the string directly above the pump, with progressively increasing rod diameters in the rod string near the earth's surface, this configuration produces a tendency to significantly buckle and bend the rod string at the rod sections of smallest diameter, that is just above the pump, and cause substantial abrasion of the rod string as well as the tubing string in which the rod and pump are disposed. Consequently, more recent design techniques have utilized rod sections of larger diameter near the bottom of the rod string and directly above the pump, and commonly known as "sinkerbars".

By way of example, a pump rod string including 1.50 inch diameter sinkerbars connected end to end in the bottom 300 feet to 500 feet of the string, directly above the pump, allows the rod string to maintain tension and allows the highest compressive or buckling forces to occur in the relatively larger diameter sinkerbar sections. Accordingly, sinkerbar sections having a larger diameter, compared to the rest of the rod string, are less likely to buckle in compression and when elastic deflection of the sinkerbars occurs and the well tubing is engaged thereby, the contact is disposed over a greater surface area and tends to reduce wear which ultimately requires replacement of the rod and/or the tubing string.

Even with the development of larger diameter rod sections or so-called sinkerbars, there have been efforts to reduce wear on the tubing string by providing, for example, a high or ultra-high density polyethylene liner inside the tubing string, which minimizes wear and friction caused by engagement with a deflected pump rod string. However, certain drawbacks are associated with this approach to reducing wear on tubing as well as rod strings, namely, a reduction in the effective inside diameter of the tubing string due to the thickness of the polyethylene liner and the requirement to install substantial lengths, up to several thousand feet, of lined tubing string in the well in order to accommodate the entire length of pump rod string which is likely to be deflected into engagement with the tubing string as a result, for example, of changing the position of the pump within the tubing string from time to time. U.S. Pat. No. 5,511,619 issued to William E. Jackson on Apr. 30, 1996 describes an example of the aforementioned approach. However, the present invention contemplates an alternative, improved solution to the problems associated with rod actuated well pumps, as discussed hereinabove.

SUMMARY OF THE INVENTION

The present invention provides an improved elongated pump rod section or sinkerbar for use with downhole rod actuated well pumps and the like.

In accordance with one aspect of the invention, an elongated pump rod or "sinkerbar" is provided which includes a sleeve of polymer material disposed over a major portion of the exterior of the rod or sinkerbar and preferably comprises polyethylene, high density polyethylene or ultra high density polyethylene. This sleeve provides a bearing surface which reduces friction and wear on the well tubing and the pump rod or sinkerbar in the event of engagement between the sinkerbar and the well tubing.

By placing a sleeve of polymer material, such as polyethylene, on the exterior of the pump rod or sinkerbar and in accordance with methods contemplated by the invention, there is no requirement to utilize non-standard tubing string sizes, and/or limit well fluid flow resulting from a reduced internal diameter of the tubing string. At the same time, the ability to maintain tension in the pump rod string and reduce wear on the pump rod string and the tubing string is provided. Moreover, by utilizing only a few hundred feet (200 feet to 500 feet) of pump rod or sinkerbar string incorporating the polyethylene or other polymer sleeve thereover, the cost of providing a wear-reducing arrangement for rod actuated well pumps is reduced.

The present invention also contemplates the provision of methods and apparatus for applying a polymer sleeve over a substantially cylindrical elongated section of a pump rod or sinkerbar. One embodiment of the method and apparatus utilizes a hydraulic cylinder which is operable to engage one end of the rod or sinkerbar and forcibly displace it within a section of stationary polyethylene tubing. Another embodiment contemplates a method and apparatus which holds the rod or sinkerbar stationary and utilizes a hydraulic cylinder actuator to forcibly displace the polyethylene sleeve over the outer diameter of the rod, still further, a third embodiment of a method and apparatus for applying a polyethylene sleeve to a sinkerbar contemplates utilizing a hydraulic cylinder actuator for displacing the sleeve over a stationary rod or sinkerbar and wherein the sleeve is applied from a continuous roll of polyethylene tubing.

Those skilled in the art will further appreciate the above-mentioned advantages and features of the invention together with other important aspects thereof upon reading the detailed description which follows in conjunction with the drawing.

DETAILED DESCRIPTION OF PREFERRED EMBODIMENTS

Figure 1:
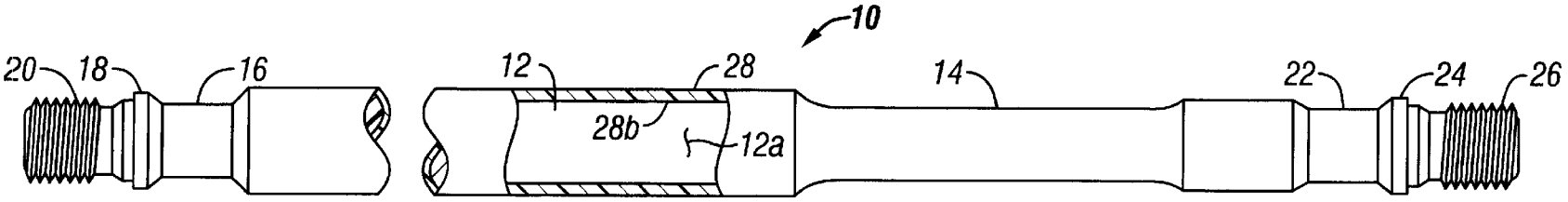
FIG. 1 is a longitudinal side elevation, partially sectioned, of a pump rod or sinkerbar including a wear resistant polymer sleeve in accordance with the present invention.

In the description which follows, like parts are marked throughout the specification and drawing with the same reference numerals, respectively. The drawing figures may not be to scale and certain features may be shown in somewhat schematic or generalized form in the interest of clarity and conciseness.

Referring to FIG. 1, there is illustrated an elongated pump rod or sinkerbar in accordance with the invention and generally designated by the numeral 10. The sinkerbar 10 comprises an elongated cylindrical rod section 12, extending over a major portion of the length of the sinkerbar and extending between a reduced diameter elevator section 14 and a first wrench flat section 16. A cylindrical collar 18 is interposed the wrench flat section 16 and an externally threaded end part 20. A wrench flat section 22 is provided adjacent the opposite end of the sinkerbar and a cylindrical collar 24 is interposed the wrench flat section 22 and a second externally threaded end part 26. The aforedescribed configuration of a pump rod section or sinkerbar is somewhat conventional. By way of example, the sinkerbar 10 may be manufactured of alloy steel, such as SAE 1045 or SAE 4623 cold finished bar, in approximately twenty-five foot lengths. Further, by way of example, the rod section 12 may have an outside diameter of about 1.375 inches, the elevator section or neck 14 having a diameter of about 1.0 inches and the wrench flats 16 and 22 also having a cross-sectional dimension of about 1.0 inches. Conventional coupling threads are provided on the externally threaded end parts 20 and 26.

The sinkerbar 10 differs from prior art sinkerbars in that an elongated polymer sleeve 28 extends over a major portion of the length of the bar and substantially covers the entire length of the rod section 12, as shown. The sleeve 28 is preferably formed of a heat and abrasion resistant polymer which also exhibits good lubricity or low friction characteristics in contact with certain other materials, such as steel tubing. High density polyethylene or ultra high density polyethylene, for example, is preferred. A preferred configuration of a sleeve 28 for a sinkerbar having a diameter of 1.375 inches for the rod section 12 is provided by a cylindrical sleeve having an inside diameter of about 1.380 inches and an outside diameter of about 1.562 inches. The inside diameter of the sleeve 28 may be slightly less than the diameter of the rod section 12 so that the sleeve is required to be stretched and then forms a slight interference fit with the rod section after being sleeved over the rod section. Alternatively, the polymer sleeve 28 may be shrink-fitted onto the rod section 12 after application thereto. However, by providing the inner diameter of the sleeve 28 to be approximately a line-to-line fit with respect to the outer diameter of a rod section 12, frictional engagement between the inner surface 28*b* of the sleeve and surface 12*a* of the rod section 12 and over a substantial length, i.e., about 25.0 feet, will maintain the sleeve in place and the difference between the coefficients of thermal expansion of the steel rod section 12 and the polyethylene sleeve will also provide for maintaining the sleeve securely on the rod section 12.

Those skilled in the art will appreciate that a pump rod section or sinkerbar according to the invention, enjoys substantial benefits. The sleeve 28 will prevent rapid wear of the sinkerbar section 12 as well as a tubing string which may come into contact with the outer surface of the sleeve. Moreover, the sleeve 28 will protect a substantial portion of the rod or sinkerbar 10 against corrosion in the highly corrosive environment of hydrocarbon wells, for example. Still further, by providing the sleeve 28, which exhibits a low coefficient of friction in contact with many materials, a pump rod string which may be deflected into engagement with the inside wall of a well tubing string will exhibit lower resistance to reciprocation in normal operation of a pumping system in which the rod is being used.

Figure 2:
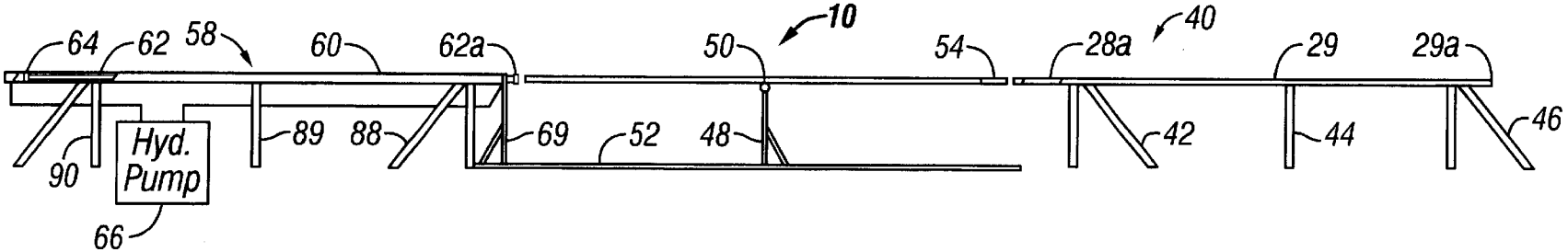
FIG. 2 is a side elevation of a first embodiment of an apparatus for applying a polymer sleeve to a sinkerbar or pump rod in accordance with the invention.

Referring now to FIG. 2, there is illustrated an apparatus and method for installing a sleeve, such as the sleeve 28, over a cylindrical rod section, such as the rod section 12 of the pump rod or sinkerbar 10. Referring to FIG. 2, a sinkerbar/sleeve assembly apparatus 40 is illustrated comprising spaced apart, vertically extending supports 42, 44 and 46 for suitably supporting a rigid tube 29, closed at one end 29*a*, and operable to receive a section of polymer tubing 28*a* therein and which will become the sleeve 28 when assembled in sleeved relationship over a pump rod or sinkerbar 10. The sinkerbar 10 is supported on one or more support members such as the support or steadyrest 48, one shown, having one or more rollers 50 mounted thereon for engagement with the sinkerbar in supportive relationship. The steadyrest 48 may be supported on a track 52 for traversal therealong to support the sinkerbar 10 as it is displaced into the interior of the tubing 28*a*. A suitable expander member or mandrel 54 may be temporarily secured to one end of the sinkerbar 10 by threaded engagement with one of the external threaded parts 20 or 26 to facilitate insertion of the sinker bar within the tubing 28*a*.

The sinkerbar 10 is pushed into the length of tubing 28*a*, which is held stationary within tube 29, by an elongated hydraulic cylinder and piston actuator 58 having a stationary cylinder member 60 and a linearly extensible and retractable piston rod 62 connected to a piston 64 slidably disposed in the cylinder 60. Actuator 58 is mounted on suitable spaced apart supports 88, 89 and 90. A hydraulic pump unit 66 is operably connected to the cylinder actuator 58 in a conventional manner for extending the piston rod 62 to displace the sinkerbar 10 into the tubing 28*a* and to retract the piston rod to the position shown in FIG. 2 for a subsequent operation. A second steadyrest 69 is mounted on the track 52 and engageable with the distal end 62*a* of piston rod 62 for movement therewith to steady the piston rod and minimize the risk of deflection of the piston rod as it inserts the sinkerbar 10 into the tubing section 28*a*. The distal end 62*a* of piston rod 62 may be provided with a suitable adapter, not shown, for engaging one end of the sinkerbar during the displacement procedure.

Figure 3:
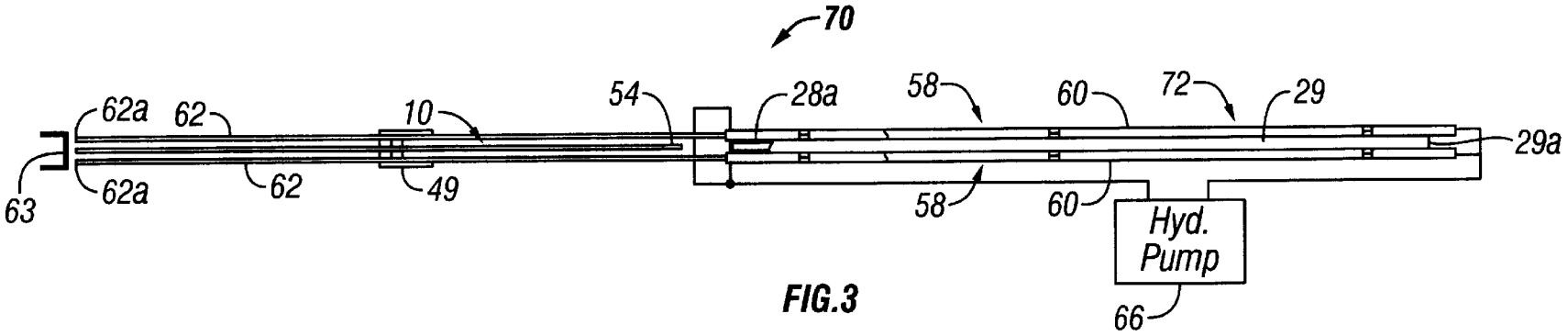
FIG. 3 is a plan view of a second embodiment of an apparatus for applying a polymer sleeve to a sinkerbar.
Figure 4:
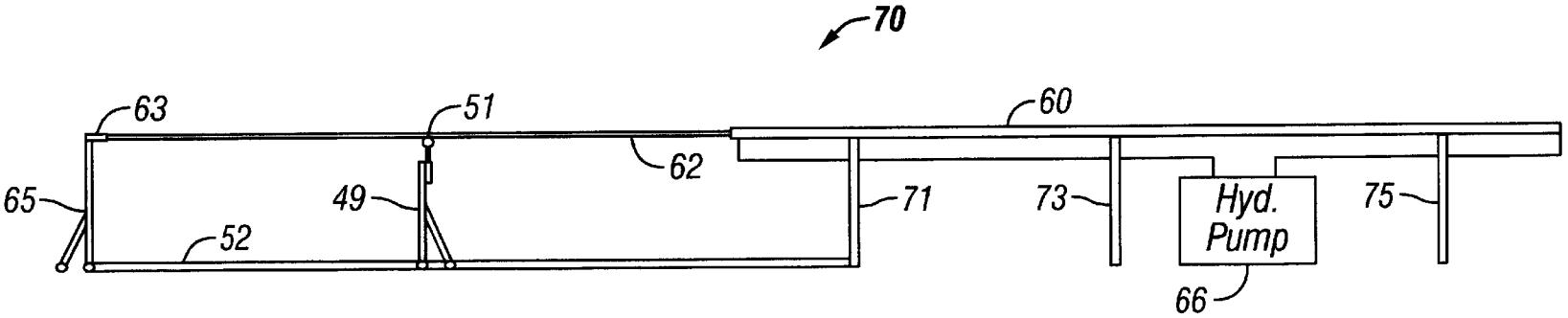
FIG. 4 is a side elevation of the apparatus shown in FIG. 3.

Referring now to FIGS. 3 and 4, an alternate embodiment of an apparatus for installing a tubing section 28*a* in sleeved relationship over a sinkerbar 10 is illustrated and generally designated by the numeral 70. The apparatus 70 includes an actuator unit 72 comprising two side-by-side hydraulic cylinder actuators 58 between which is mounted the rigid tube 29 for holding the polyethylene tubing section 28*a* therein, as shown in FIG. 3. The hydraulic cylinder actuators 58 and the tube 29 are suitably supported on spaced apart vertically extending support legs 71, 73 and 75, FIG. 4. Hydraulic pump unit 66 is operably connected to both of the actuators 58 in a suitable manner for extending and retracting side-by-side linearly extensible piston rods 62. The piston rods 62 are connected at their distal ends 62*a*, respectively, to a pusher member 63 and a support 65 therefor. Support 65 is mounted on suitable rollers for linear traversal along track 52. An intermediate support or steadyrest 49, similar to the support 48, includes an extensible rest member 51 comprising a pneumatic cylinder, for example, to align and steady the sinkerbar 10 as it is pushed into the tubing section 28*a* which is held stationary in the tube 29. An expander mandrel 54 is temporarily secured to one end of the sinkerbar 10 to facilitate insertion of the sinkerbar as it is pushed into the tubing section 28*a* by retracting the piston rods 62, simultaneously, into their respective cylinders 60.

Figure 5:
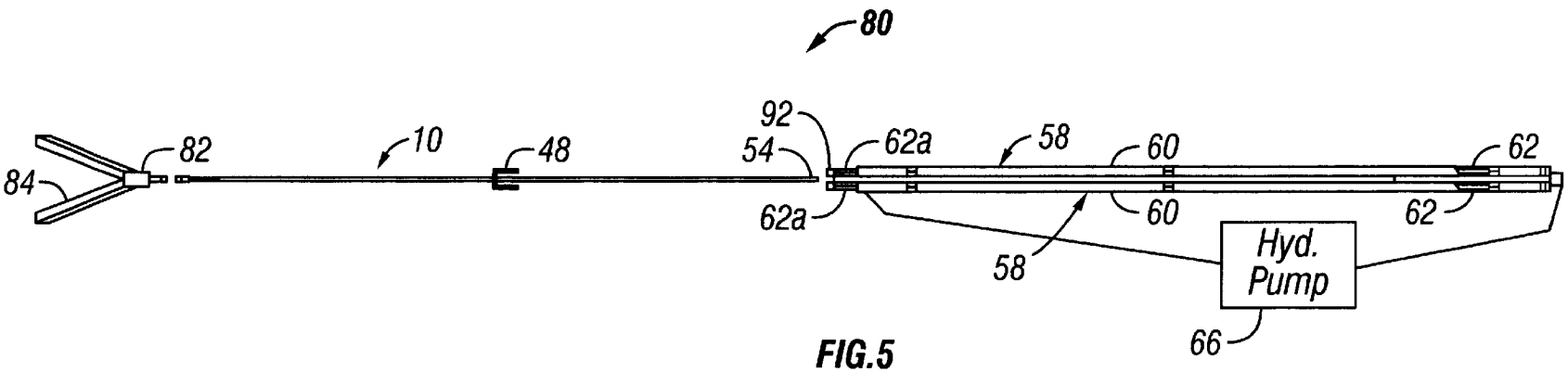
FIG. 5 is a plan view of a third embodiment of an apparatus for applying a polymer sleeve to a sinkerbar in accordance with the invention.
Figure 6:
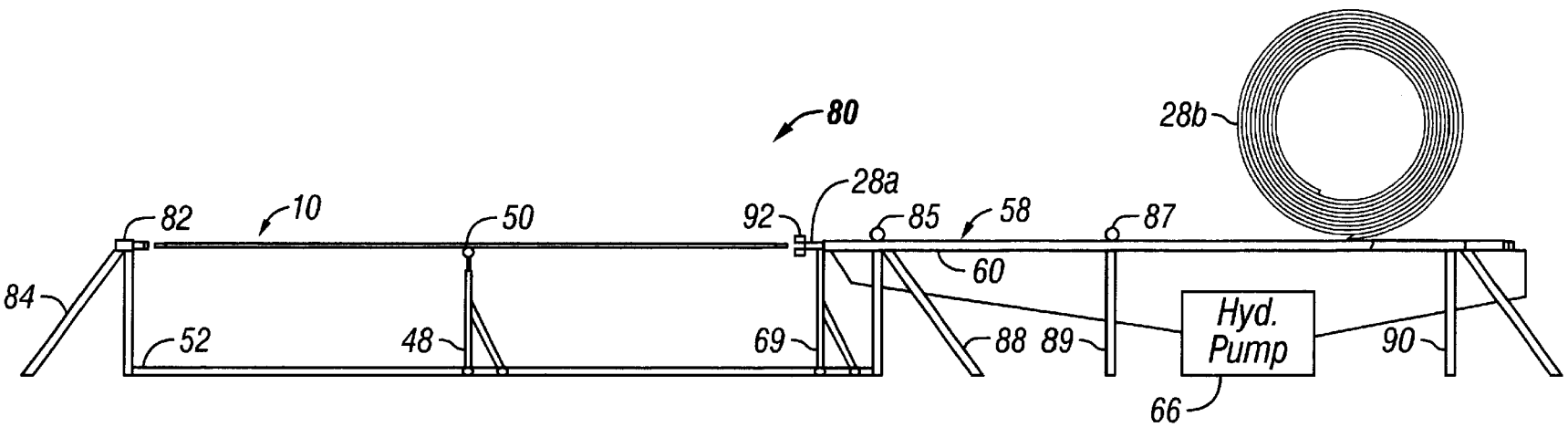
FIG. 6 is a side elevation of the apparatus shown in FIG. 5.

Referring now to FIGS. 5 and 6, another embodiment of an apparatus for sleeving a section of polyethylene tubing over a sinkerbar 10 is illustrated and generally designated by the numeral 80. The apparatus 80 includes the roller track 52, at least one support or steadyrest 48 for a sinkerbar 10 and an abutment 82 mounted on a suitable support 84. The abutment 82 is engageable with one end of the sinkerbar 10 to hold the sinkerbar stationary when a section 28*a* of polyethylene tubing is sleeved thereover. The tubing section 28*a* may be unreeled from a suitable storage spool or reel 28*b* of a continuous length of tubing and the tubing section is traversed through spaced apart sets of straightening rollers 85 and 87, which are suitably mounted on spaced apart supports 88, 89 and 90.

Side-by-side cylinder actuators 58 are also mounted on the supports 88, 89 and 90 and their respective linearly extensible piston rods 62 are connected at distal ends 62*a* to a head 92, which is also connected to one end of tubing section 28*a* for pulling the tubing section 28*a* from reel 28*b* and sleeving it over the sinkerbar 10 as the piston rods 62 are extended toward the abutment 82. A steadyrest 69 is also connected to the piston rods 62 adjacent their distal ends 62*a* and traverses the track 52 to reduce deflection of the rods as they are extended from the respective cylinders 60.

Accordingly, a sleeve 28 may be extended in sleeved relationship onto a sinkerbar 10 over its rod section 12 by one of several methods as described and illustrated.

Although a preferred embodiment of a well pump rod or sinkerbar has been described herein together with preferred embodiments of methods and apparatus for assembling a polymer sleeve over a pump rod section or sinkerbar, those skilled in the art will recognize that various substitutions and modifications may be made to the invention without departing from the scope and spirit of the appended claims.

What is claimed is:

1. An elongated pump rod for use in a pump rod string for a downhole well pump, said pump rod including a generally cylindrical rod section extending over a major portion of the length of said pump rod, said pump rod including means formed thereon for coupling said pump rod to said pump rod string, and an elongated sleeve extending over said cylindrical rod section and secured in engagement therewith, said sleeve being formed of a wear resistant polymer material comprising one of high density polyethylene and ultra high density polyethylene.

2. The pump rod set forth in claim 1 wherein:

the coefficient of friction of said sleeve with respect to a well tubing in which said pump rod is disposed is less than the material of said pump rod.

3. The pump rod set forth in claim 1 wherein:

said sleeve has an inner diameter in a relaxed condition slightly less than the outer diameter of said cylindrical rod section.

4. The pump rod set forth in claim 1 wherein:

said sleeve has an inner diameter in a relaxed condition substantially the same as the outer diameter of said cylindrical rod section.

5. The pump rod set forth in claim 1 wherein:

the coefficient of thermal expansion of said sleeve is substantially the same as the coefficient of thermal expansion of alloy steel.

6. A method for fabricating an elongated pump rod for a downhole well pump wherein said pump rod includes a sleeve of polymer material extending over a major portion of the length of said pump rod, said method comprising the steps of:

providing an apparatus for supporting said pump rod and said sleeve, said apparatus including a linearly extensible and retractable actuator connected to one of said pump rod and said sleeve; and operating said actuator to move said sleeve relative to said pump rod into sleeved relationship thereover.

7. The method set forth in claim 6 including the steps of:

supporting said sleeve stationary relative to said actuator and causing said actuator to push said pump rod into said sleeve.

8. The method set forth in claim 7 including the steps of:

supporting said sleeve within an elongated tube during insertion of said pump rod within said sleeve.

9. The method set forth in claim 6 including the steps of:

supporting said pump rod stationary with respect to said actuator and causing said actuator to pull said sleeve over said pump rod from one end of said sleeve.

10. The method set forth in claim 9 including the step of:

providing said sleeve from a continuous length of polymer tubing and pulling said tubing from one end into engagement with and sleeved over said pump rod.

11. The method set forth in claim 6 including the step of:

supporting said pump rod at one end by said actuator and at an intermediate point between said one end and the opposite end of said pump rod.

12. The method set forth in claim 6 including the step of:

supporting said pump rod intermediate the ends thereof on a support which is movable relative to said pump rod and actuator in response to sleeving said sleeve over said pump rod, and engaging said pump rod at one end thereof with an abutment to hold said pump rod stationary with respect to said sleeve while said sleeve is being pulled over said pump rod at an opposite end of said pump rod and in sleeved relationship thereto.

13. The method set forth in claim 6 including the step of:

providing an expander mandrel connected to one end of said pump rod; and inserting said expander mandrel into one end of said sleeve while moving said sleeve relative to said pump rod to elastically deform said sleeve for extending said sleeve over a major portion of said length of said pump rod and in sleeved relationship thereto.

14. An elongated sinkerbar for use in a pump rod string for a downhole well pump, said sinkerbar including opposed end parts adapted for coupling said sinkerbar into said pump rod string, an elevator section of said sinkerbar adjacent one of said end parts and an elongated rod section having a diameter greater than said elevator section and said end parts, said elongated rod section having a sleeve of polymer material extending thereover and secured thereto by a forcible fit between the outer surface of said rod section and an inner surface of said sleeve, said sinkerbar being formed by an apparatus for supporting said sinkerbar and said sleeve and including a linearly extensible and retractable actuator connected to one of said sinkerbar and said sleeve and whereby said sinkerbar is formed by operating said actuator to move said sleeve relative to said rod section in to sleeved relationship thereover.

15. The sinkerbar set forth in claim 14 wherein:

said sleeve is formed of one of high density polyethylene and ultra high density polyethylene.

16. The sinkerbar set forth in claim 14 wherein:

said sleeve has an inner diameter in a relaxed condition substantially the same as the outer diameter of said rod section.

17. The sinkerbar set forth in claim 14 wherein:

said sinkerbar is provided with an expander mandrel connected to one of said end parts for expanding the inner diameter of said sleeve while said sleeve is moved relative to said sinkerbar into sleeved relationship over said rod section.

18. An elongated pump rod for use in a pump rod string for a downhole well pump, said pump rod including a generally cylindrical rod section extending over a major portion of the length of said pump rod, said pump rod including means formed thereon for coupling said pump rod to said pump rod string, and an elongated seamless tubular sleeve extending over said cylindrical rod section and having a cylindrical exterior surface for engagement with the interior surface of a cylindrical well tubing, said sleeve having an inner diameter in a relaxed condition slightly less than the outer diameter of said cylindrical rod section and secured in forcible engagement therewith, said sleeve being formed of a wear resistant polymer material having a coefficient of friction with respect to said well tubing which is less than the material of said pump rod, and the material of said sleeve having a coefficient of thermal expansion which is substantially the same as the coefficient of thermal expansion of alloy steel.

* * * * *